US008756900B1

(12) United States Patent
Hudson et al.

(10) Patent No.: US 8,756,900 B1
(45) Date of Patent: Jun. 24, 2014

(54) SYSTEM AND METHOD OF PREPARING STRUCTURAL BEAMS WITH GUSSET RETAINING SLOTS

(76) Inventors: Peter Arthur Hudson, Bradenton, FL (US); Pam Ellen Hudson, Ventura, CA (US)

( * ) Notice: Subject to any disclaimer, the term of this patent is extended or adjusted under 35 U.S.C. 154(b) by 78 days.

(21) Appl. No.: 13/156,334

(22) Filed: Jun. 8, 2011

Related U.S. Application Data

(60) Provisional application No. 61/352,915, filed on Jun. 9, 2010.

(51) Int. Cl.
*E04C 3/04* (2006.01)

(52) U.S. Cl.
USPC ..... 52/844

(58) Field of Classification Search
USPC ..... 52/844, 63; 135/913; 160/392
See application file for complete search history.

(56) References Cited

U.S. PATENT DOCUMENTS

| | | | | |
|---|---|---|---|---|
| 6,385,941 | B1 * | 5/2002 | Power et al. | 52/844 |
| 6,601,362 | B1 * | 8/2003 | Prince | 52/844 |
| 6,668,495 | B1 * | 12/2003 | Prince | 52/63 |
| 6,755,004 | B1 * | 6/2004 | Power et al. | 52/845 |
| 7,568,323 | B2 * | 8/2009 | Shelton et al. | 52/844 |
| 7,877,962 | B2 * | 2/2011 | Teffenhart, Jr. | 52/844 |

* cited by examiner

*Primary Examiner* — Andrew J Triggs
(74) *Attorney, Agent, or Firm* — Dorothy S. Morse

(57) ABSTRACT

A system and method of preparing residential and commercial screen enclosures using box beams having a two-piece construction from identical extruded parts, which are self-mating and connected with fasteners, or snap-fitted together without fasteners. The box beam so formed is strong and easy to construct, and preferred in the front walls and roof designs of gable, mansard, dome, and flat screen enclosures. Both extruded parts of the box beam have a planar central member with two substantially perpendicular side pieces each having an exterior-facing spline and screen-edge retaining groove. In addition, an interior-facing gusset-retaining slot is created between each spline groove and the planar central member, with each pair of opposed slots configured and positioned to receive a tightly-fitting gusset plate that provides stronger and more precise box beam joints than is possible with gusset plates secured only by fasteners, as is common in prior art beam construction.

13 Claims, 5 Drawing Sheets

SYSTEM AND METHOD OF PREPARING STRUCTURAL BEAMS WITH GUSSET RETAINING SLOTS

CROSS-REFERENCE TO RELATED APPLICATIONS

This application is being filed by the same inventors of a U.S. provisional patent dated Jun. 9, 2010, having the Ser. No. 61/352,915, and also having a title of "Gusset Retaining Slot in Snap and Self-Mating Aluminum Beams". Since the subject matter of the patent application herein is substantially related to that of the above-identified provisional patent application, and the one-year term for this provisional patent application has not expired, the inventors herein request that domestic priority be granted for their instant patent application based upon the above-referenced filing date of Ser. No. 61/352,915.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

1. Field of the Invention

The present invention relates to beams used in the construction of screen enclosures that enclose pools, patios and other outdoor facilities (wherein purlins are often used in roofs to avoid closely spaced rafters), more particularly to a system and method of preparing residential and commercial screen enclosures using box beams for structural wall and roof support that each have a two-piece construction from identical extruded parts, which are preferably either self-mating and joined with fasteners, or snap-fitted together without fasteners. Each extrusion has a generally U-shaped configuration, with a planar central member and two side pieces each depending in substantially perpendicular orientation to the central member. Each extrusion further comprises an interior gusset-retaining slot formed between the planar central member and an exterior spline groove on each side piece, wherein slots positioned in opposed relation to one another are configured to receive and support a precisely cut and tight-fitting gusset plate, which provides more precise beam construction and enhanced (more precise and stronger) joint reinforcement for wall and roof beams positioned in end-to-end relation. Two gusset plates are used in each present invention structural joint, with each gusset plate partially inserted into both beams in the structural joint and secured to the aligned planar central members on opposing sides of the beams via fasteners. Although several fasteners are typically used to secure the present invention tight-fitting gusset plates to the beams in a structural joint, fewer fasteners are used than would otherwise be needed in prior art beams constructed without the structural benefit of present invention interior gusset-retaining slots (saving both labor and material expense). Also, the opposed slots in present invention box beams allow for the joining of two roof beams in a manner that does not interfere with the placement of fasteners in roof purlins. Box beams formed by present invention construction are strong and easy to construct, and thus preferred over prior art box beams in the front walls and roof designs of gable, mansard, dome, and flat screen enclosures. In addition, the tight-fitting gusset plates supported in part by the opposed interior slots of present invention beams provide more precise joints, which allows the construction and joining of such beams to be accomplished with more accuracy and efficiency, and also results in greater screen enclosure strength. Advantages of the present invention system and method include, without limitation, stronger construction of aluminum beams, and tailored construction of aluminum beams to an exact fitted specification which greatly reduces the likelihood of construction error and also results in consistently better-quality and stronger screen enclosure joints. Furthermore, the improved and stronger joint component of the present invention provides a consistent graduation in strength from one beam to another and efficient use of the box beam metal. Consequently, screen enclosures made from present invention box beams are stronger, and able to withstand higher winds and better resist damage as a result of impact from external forces, than screen enclosures made from other box beams currently used in the industry.

2. Description of the Related Art

Screen enclosures are commonly used in both residential and commercial applications to enclose pools, patios and other outdoor facilities. Such screen enclosures generally start as a frame constructed from different types of aluminum beams. To complete the enclosure, screening is stretched over the frame, and screening edges are secured to the structural beams using flexible splines and the spline grooves preformed into the exterior surface of the structural beams. Screen enclosures are also constructed in accordance with various local building codes, and when applicable may include additional means of structural reinforcement (such as but not limited to tensioned cables).

Generally, the construction of screen enclosures involves considerable difficulty, and requires extensive experience and skill. With respect to the aluminum structural members that are currently and commonly used for the upright wall beams and roof beams in prior art screen enclosures, such beams typically consist of two identical extrusions joined together via self-mating construction and multiple fasteners to form a generally rectangular box beam configuration. However, precision in the construction of such box beams is often lacking, which results in considerable room for frequent (and sometimes serious) error during screen enclosure construction, and may potentially lead to construction delay, compromised strength in a finished screen enclosure, and/or other screen enclosure deficiencies. In addition to imprecise beam construction, prior art methods used to create structural joints in screen enclosures are also a source of construction error and reduced screen enclosure strength. Since the gusset plates used in the prior art are smaller in dimension than the interior surface of a box beam to which it becomes attached, installers generally estimate its positioning relative to the box beam before attaching fasteners (most commonly screws). However, even when a slight difference in gusset plate positioning exists from one beam to the next, and particularly when the differences are varied and repeated in many of the structural joints in a screen enclosure, such imprecision in gusset plate positioning will provide less than optimal strength in a finished screen enclosure, and reduced enclosure resistance of the screen enclosure to wind and impact damage. Also, since the beams in prior art screen enclosure construction are solely bound together via the fasteners securing two gusset plates between them, the graduation in strength from one prior art beam to another is inconsistent and results in the metal being used inefficiently, and further places all of the stress in the joint on the fasteners. As a result, a relatively weak fastening component is provided when compared to the slot/fastener alternative provided in the present invention. Thus, a need exists for improved beams (stronger and more precisely constructed) to use in the assembly of screen enclosures, and for an improved method of joining beams during the construction of aluminum screen enclosures that enhances their strength and durability, instead of diminishing it.

BRIEF SUMMARY OF THE INVENTION

It is the primary object of this invention to provide a system and method for use in the construction of screen enclosures that creates more precisely constructed and considerably stronger beams and joints than are currently found in prior art screen enclosures. It is a further object of this invention to provide box beams with opposed slots that allow for the joining of two roof beams in a manner that does not interfere with the placement of fasteners in roof purlins. It is also an object of this invention to provide a type of box beam construction that allows the creation of screen enclosures with more accuracy, efficiency, and speed. Another object of this invention is to provide a method for the tailored construction of aluminum beams to an exact fitted specification which greatly reduces the likelihood of construction error. It is a further object of this invention to provide a system and method of creating screen enclosures using aluminum box beams wherein the graduation in strength from one beam to another is consistent, resulting in the metal being used efficiently and enhanced screen enclosure strength. It is also an object of this invention to provide a type of box beam construction that allows screen enclosures made therefrom to withstand higher winds and better resist impact from external forces than other box beams currently and commonly used in the industry. In addition, it is also an object of this invention to provide a box beam configuration that can be made from any extruded material having sufficient rigidity and strength in a needed application, such as but not limited to aluminum, high strength plastic, other metals, and the like.

The present invention answers current needs in the industry by providing a two-piece box beam with a gusset-retaining slot in each of its four corners, between the interior face of the beam's planar central member and each of its exterior-facing spline grooves, with the interior-facing slots each configured to accept the lateral edge of a gusset plate, so that two gusset plates can be used to securely fix each pair of box beams in a structural joint without interfering with the placement of fasteners in roof purlins. In the most preferred embodiment of the present invention, although not limited thereto, each gusset-retaining slot preferably has a width dimension of approximately one-fourth of an inch and the gusset plate inserted into the slot preferably has a thickness dimension of approximately three-sixteenths of an inch. It is also intended for the present invention gusset plate to be sufficiently wide to provide tight-fitting gusset plate edge positioning within both of the paired (opposed) interior slots into which it is inserted, yet still allow easy sliding of the gusset plate into its position of use within the ends of both box beams intended for use in creating a structural joint. The present invention method involves precise construction of an aluminum (or other material) box beam from two identical extrusions, either by self-mating or by fitted snap construction, with the side pieces of the paired self-mating extrusions further requiring fasteners for secure and fixed attachment of one to the other. Although current construction typically provides screen enclosures made from aluminum structural components, and the word 'aluminum' is used many times in this invention disclosure as a preferred material for manufacture of its beams, it should be noted that it is also contemplated for the present invention system and method of building screen enclosures (and other enclosures) to include extrusions made from aluminum and/or other materials that would have the strength and other characteristics dictated by local building codes, or which are otherwise considered appropriate to an application. The opposed interior gusset-retaining slots in present invention structural beams are not found in the prior art, nor is the fitted snap beam configuration shown in the accompanying illustrations.

The opposed slots in present invention beams accept a tight-fitting gusset plate that provides more precise and efficient construction of a box beam, as well as more precise formation of joints involving beams placed in end-to-end relation with one another in the structural joint of a screen enclosure. While fasteners are also used to secure the two gusset plates to each present invention beam used in a structural joint, and they provide part of the joint's strength, joint strength in present invention beams is enhanced by a contribution from the interior/opposed gusset-retaining slots, and joint strength no longer depends solely on the fastening component (as it does in the prior art). Thus, present invention gusset-retaining slots allow box beam assembly without the inaccurate estimates typically occurring in prior art screen enclosure construction, and the resulting joint between present invention beams placed in end-to-end relation is stronger, easier to construct, and more precise in its construction, with use of present invention beams being preferred in the construction of the front walls and roof designs of gable, mansard, dome and flat screen enclosures. Furthermore, present invention box beams with their opposed slots allow for the joining of two roof beams in a manner that does not interfere with the fastener placement in roof purlins, another advantage of the present invention over the prior art. In addition, in applications where greatly enhanced strength of a screen enclosure is not a major concern, the support contribution from the present invention gusset-retaining slots allow two beams to be precisely joined together using thinner gusset plates than would be possible in prior art construction, which lowers material cost in present invention screen enclosure construction without any compromise in strength over an enclosure created by prior art beams without gusset-retaining slots. Thus, the present invention has many advantages over the prior art, including but not limited to providing a more efficient method of constructing screen enclosures, stronger screen enclosures, and the construction of screen enclosures with less labor and material cost.

DETAILED DESCRIPTION OF THE INVENTION

Figure 1:
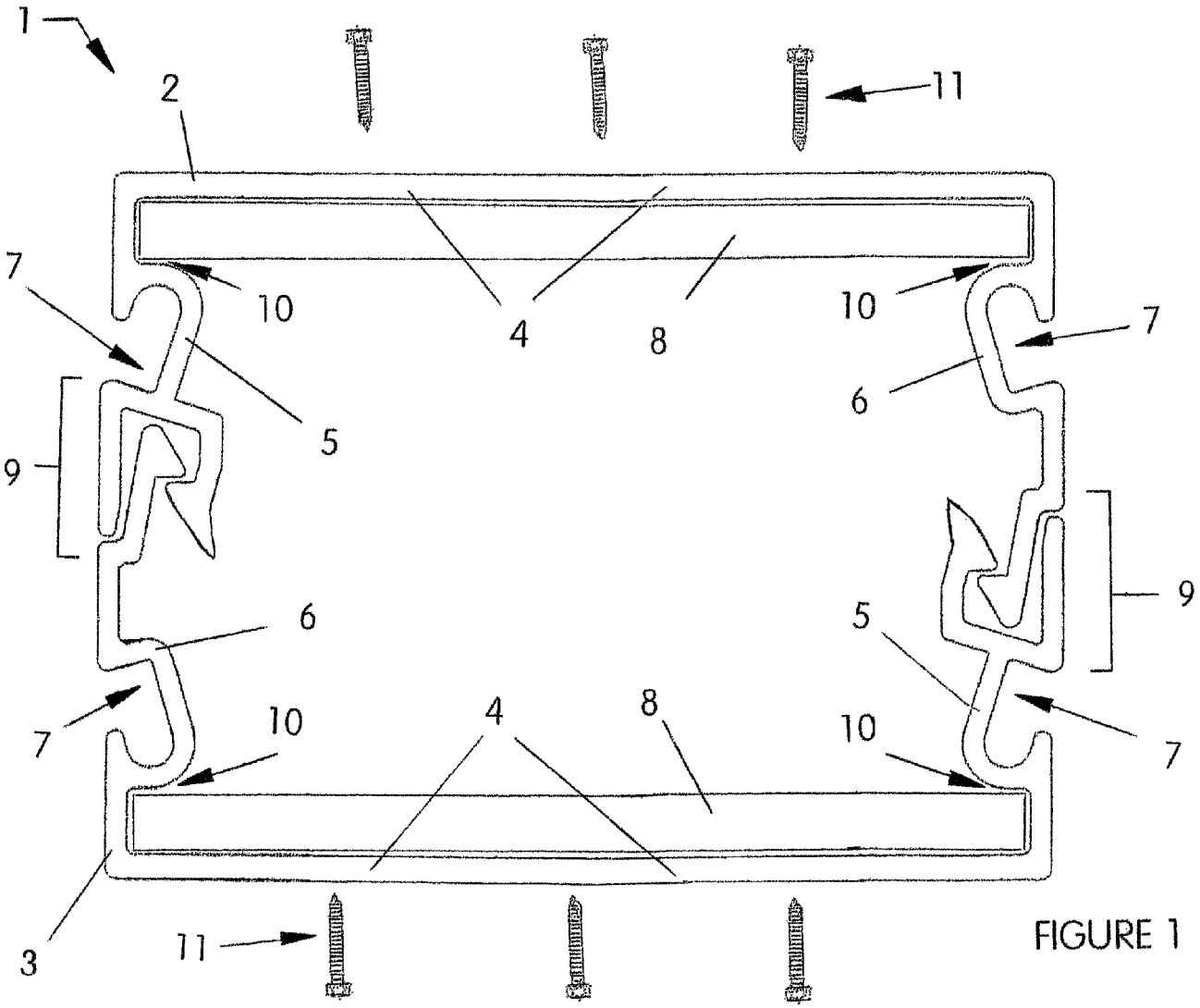
FIG. 1 is an end view of a first preferred embodiment of a present invention aluminum box beam made from two identical fitted snap slot extrusions, two tight-fitting gusset plates each inserted between a different set of opposing gusset slots, and several fasteners poised for connection of each gusset plate to an adjacent portion of the box beam.
Figure 2:
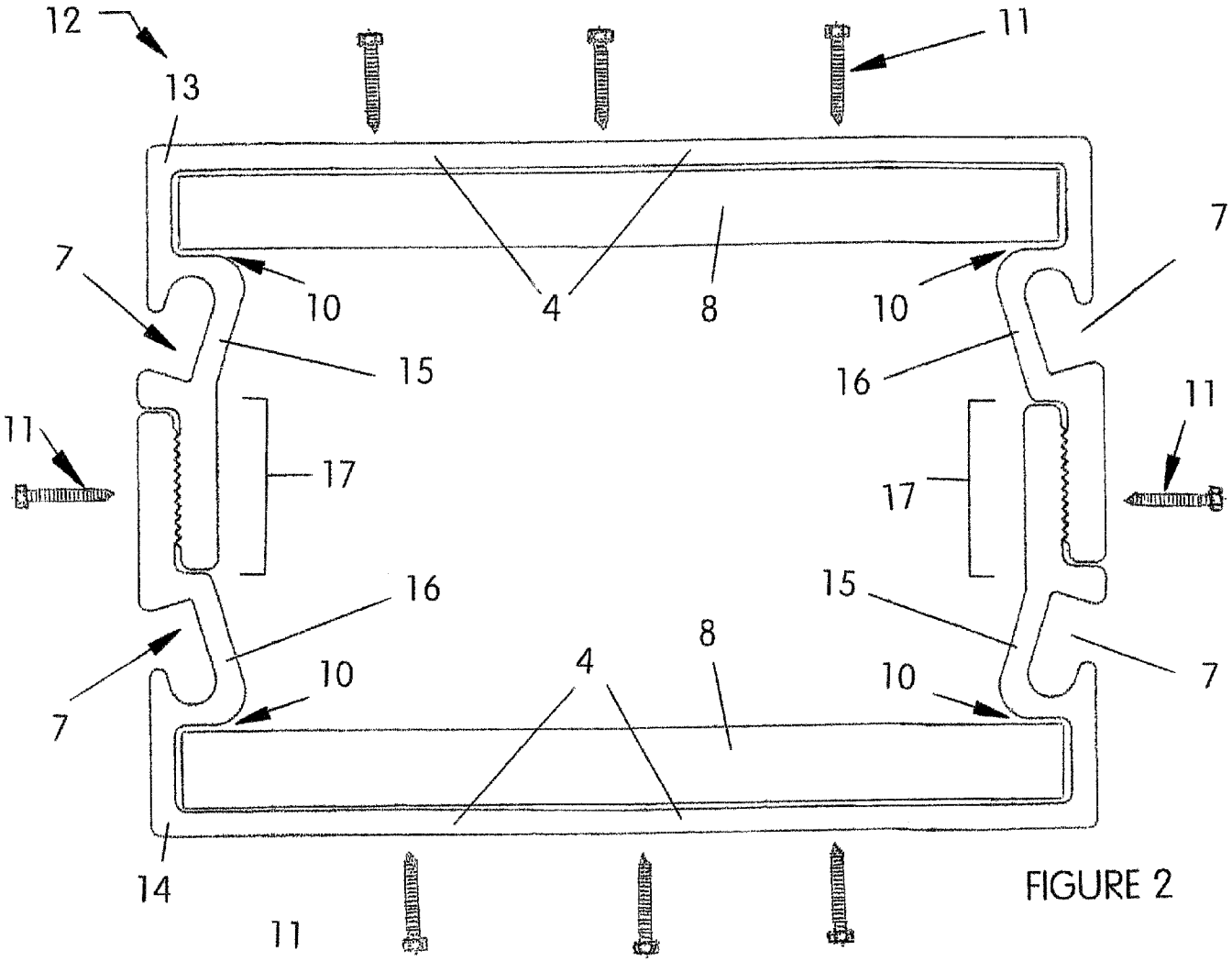
FIG. 2 is an end view of a second preferred embodiment of a present invention aluminum box beam made from two identical self-mating slot extrusions, two tight-fitting gusset plates each inserted between a different set of opposing slots, a fastener poised for securing the side pieces of opposing extrusions to one another in each of two self-mating connections, and several fasteners poised for connection of each gusset plate to an adjacent portion of the box beam.

The most preferred embodiment of the present invention provides a two-piece box beam (identified in FIGS. 1 and 2 respectively by the numbers 1 and 12) that is made from two identical extrusions (marked as 2 and 3 in FIG. 1, and marked as 13 and 14 in FIG. 2, with an approximately one-fourth inch wide (or other similar width dimension) gusset-retaining slot 10 positioned in each of its four interior corners. As can be seen in both FIG. 1 and FIG. 2, it is contemplated for slots 10 in the present invention (and thus its four interior corners) to be L-shaped. Although the most preferred embodiment of box beam (1 or 12) is made from aluminum, manufacture of preferred embodiments of present invention box beams (1, 12, and other) is also contemplated from any sufficiently rigid and strong material for the intended application, such as high-strength plastic, other metals, and the like. In addition, the most preferred embodiment of the present invention provides assembly of box beams (1, 12, and other) into screen enclosures using a tight-fitting gusset plate 8 positioned within and between paired/opposed slots 10 that are facing one another, and the gusset plate 8 used in the most preferred embodiment of the present invention between two approximately one-fourth inch wide opposed slots 10 would be expected to have a thickness dimension of approximately three-sixteenths of an inch. Since each present invention beam (1, 12, or other) has two extrusions each with a pair of opposed slots 10, each structural joint in a screen enclosure would have two gusset plates 8 secured between beams (1, 12, or other) placed in end-to-end relation with one another. In addition, the gusset plate 8 used in the most preferred embodiment of the present invention would have a sufficient length dimension that allows it to substantially fill both opposed slots 10, as well as extend across the full length/distance between slots 10, yet still allow gusset plate to slide easily into its position of use adjacent to one of the longer sides (also referred to herein as "planar central member 4") of box beam (1 or 12) before being secured to the planar central member 4 via several fasteners 11. Present invention box beams (1, 12, and other) can be constructed from self-mating extrusions (see 13 and 14 in FIG. 2), or from fitted snap extrusions (see 2 and 3 in FIG. 1). Furthermore, while FIGS. 1 and 2 respectively show fasteners 11 poised to provide a connection between gusset plates 8 and the box beams 1 or 12, as well as provide the needed connection of the side pieces 15 and 16 to one another in the self-mating connections 17 shown in FIG. 2, it should be understood that the number of fasteners 11 shown is provided only by way of example, and should not be considered as limiting to the invention disclosed herein.

Figure 4:
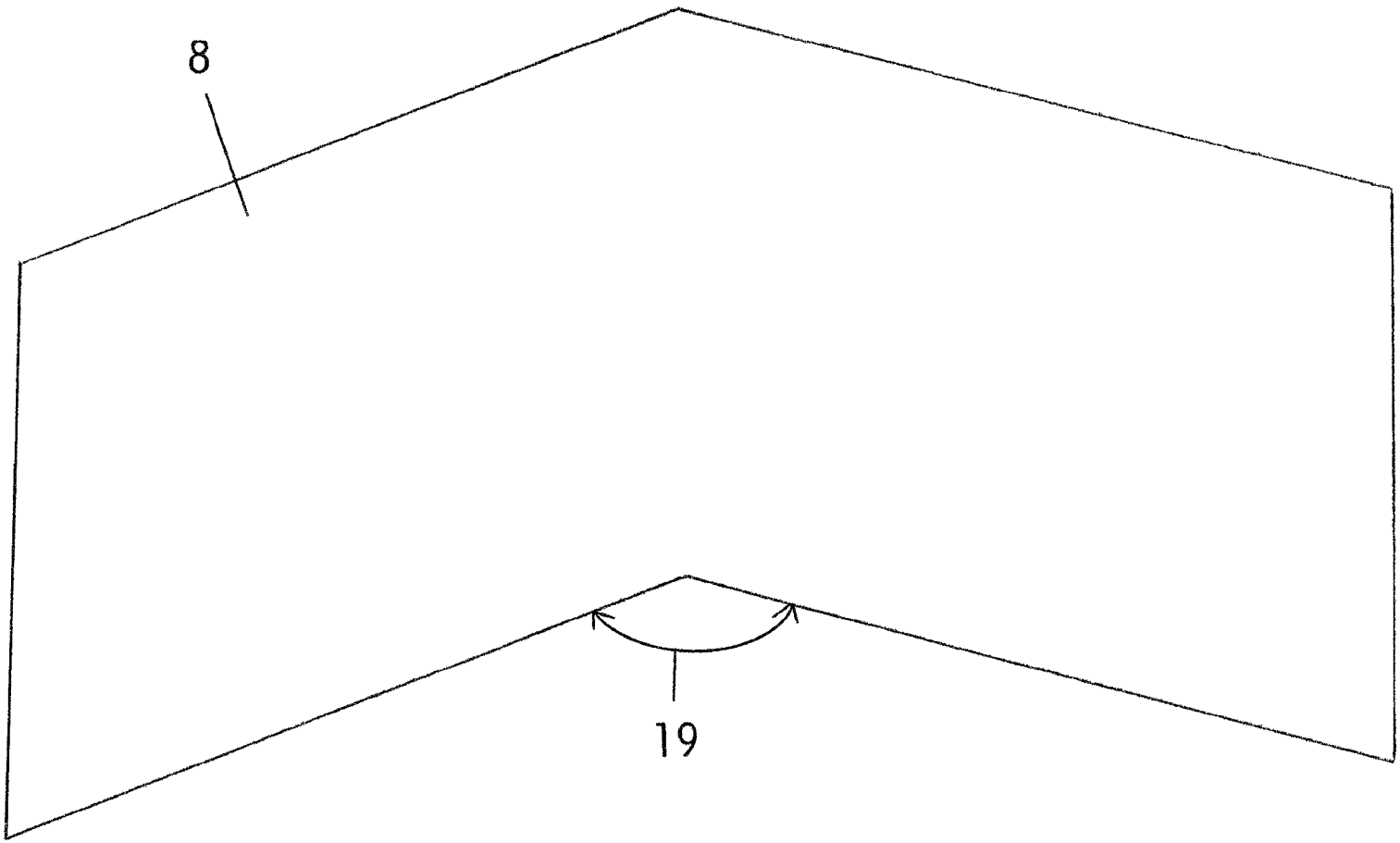
FIG. 4 is a side view of gusset plate that can be used as a part of the present invention to strengthen the extrusions joined together to form a box beam, as well as strengthen structural joints between two such beams placed in end-to-end relation with one another, with a double-headed arrow identifying the angle needed to define roof pitch in a structural joint having an upright wall beam and a roof beam.
Figure 5:
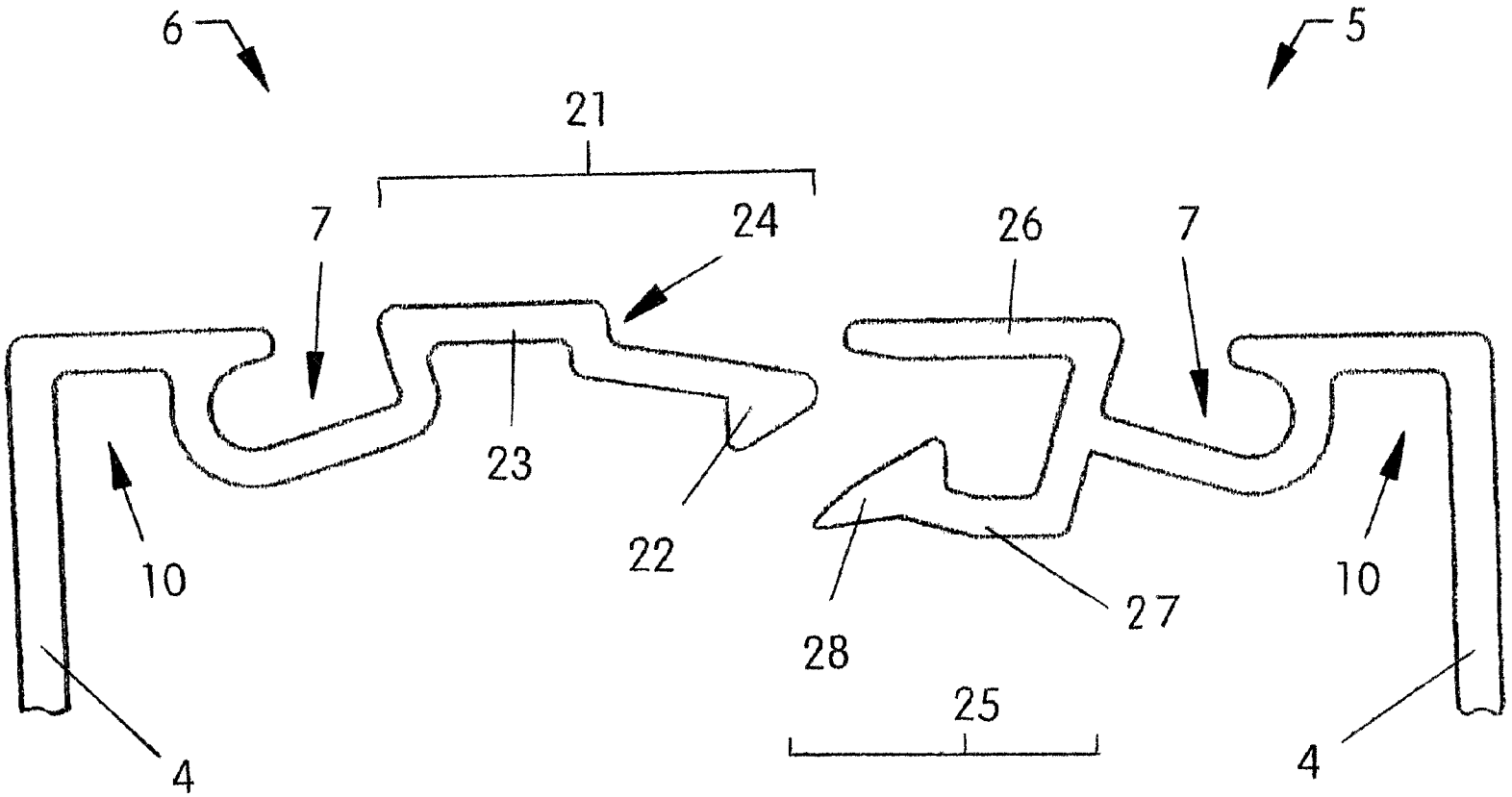
FIG. 5 is an enlarged and more detailed view of the fitted snap connection used in FIG. 1 to secure the side pieces of opposing extrusions together to form a box beam.

The gusset-retaining slots 10 used in the present invention are not available in the prior art box beams (such as the beam 20 shown in FIG. 3), and its slots 10 allow for a more precise and efficient construction/fitting of two present invention beams (1, 12, or other), the use of which results in the formation of stronger screen enclosures. While FIGS. 1 and 2 show two examples of present invention box beams with gusset-retaining slots 10, FIG. 3 in contrast shows a common prior art self-mating beam 20 (without slots 10) which has the sides of its extrusions 18 secured together with fasteners 11 (similar to the self-mating connections 17 used in present invention box beam 12, see FIG. 2). In addition, FIG. 4 shows an example of a gusset plate 8 that is suitable for use with present invention beams (1, 12, and other) in certain screen enclosure roofing applications (with the advantage in the present invention being that gusset plate 8 is tight-fitting within two opposed slots 10 which allows the construction and joining of beams (1, 12, and other) with less construction error), and FIG. 5 shows an enlarged and more detailed view of the fitted snap connection 9 used in the present invention box beam 1 shown in FIG. 1 (that is also not found in the prior art).

The configurations of the four interior gusset-retaining slots 10 in a present invention box beam (1, 12, or other) are each defined by a different one of the four exterior-facing spline grooves 7 and an adjacent lateral edge on one of the two planar central members 4 each creating one of the two opposed longer sides of box beam (1, 12, or other), with one pair of interior-facing opposed gusset-retaining slots 10 located on each of its two extrusions (marked as 2 and 3 in FIG. 1, and marked as 13 and 14 in FIG. 2). Since a gusset plate 8 (such as but not limited to that shown in FIG. 4) inserted into the end of a present invention beam (such as 1 or 12) should be tight-fitting within the two opposed slots 10 that contain its lateral edges, and also should be able to slide easily between the two opposed slots 10 into its position of use while it remains substantially parallel to the adjacent planar central member 4 (to which it will eventually become attached with fasteners 11), a gusset plate 8 used with the most preferred embodiment of the present invention (having slots 10 approximately one-fourth of an inch wide) is preferred to have a minimum thickness dimension of approximately three-sixteenths of an inch. For special applications, the width and thickness dimensions respectively of slot 10 and gusset plate 8 can be different from the dimensions noted immediately hereinabove, as long as gusset plate 8 remains tight-fitting within its position of use between two opposing slots 10. Stated another way, since it is contemplated for the perimeter of preferred present invention box beams (1, 12, and other) to have width dimensions of approximately two inches, and length dimensions between approximately four and nine inches, the corresponding width dimension of gusset plate 8 used in structural joints with such beams would be slightly less than the beam's approximately four-to-nine inch length dimension and also small enough to allow it to slide easily and promptly into its intended position of use. It should be appreciated that the gusset plate 8 shown in FIG. 4 has a pre-formed angle 19 (identified by a two-headed arrow) for certain roofing applications, and in differing applications angle 19 is expected to vary from that shown.

When the present invention box beam 1 in FIG. 1 is formed by the joining of its two fitted snap connections 9 (see FIG. 5 for an enlarged view thereof), no fasteners 11 (or other) are required for securing side pieces 6 and 5 to one another. In the alternative, when present invention box beam 12 is formed by self-mating connection 17 (see FIG. 2), fasteners 11 (or other)

are required to secure side pieces 15 and 16 together to create and maintain the rectangular box beam 12 configuration needed during screen enclosure use. As one can see in FIGS. 1 and 2, the configurations of side pieces 5 and 6 are not identical to one another in extrusions 2 and 3, nor are the configurations of side pieces 15 and 16 in extrusions 13 and 14. Also, in FIG. 2, one can see that a portion of the configuration of exterior-facing spline groove 7 on side piece 15 provides an end stop for side piece 16 to define the maximum length of connection 17 after mating of side pieces 15 and 16, and the reverse also occurs wherein a portion of the configuration of exterior-facing spline groove 7 on side piece 16 also provides an end stop for side piece 15 when it becomes mated with side piece 16. Thus, both self-mating connections 17 in box beam 12 can be easily and promptly secured with fasteners (11 or other), similar to that provided in the prior art (see FIG. 3) where spline groove 7 configuration provides end stops for its self-mating connections 17. FIG. 2 also shows the two self-mating connections 17 present each having a preferred non-slip/serrated internal configuration, which is also shown in FIG. 3 as part of the formation of prior art box beam 20.

In contrast, the fitted snap connections 9 shown in FIG. 1 have features not defined by the adjacent exterior-facing spline grooves 7, which are shown in the enlarged view of FIG. 5. As can be seen in FIGS. 1 and 5, side piece 6 of box beam 1 incorporates a male end 21 that has a substantially triangular-shaped tip 22 that is inwardly angled from its proximal portion 23, with the void area 24 (where the angled orientation of the distal portion of male end 21 begins) providing an end stop for the straight-walled portion 26 of the female end 25 depending from side piece 5 (see FIG. 1). In addition to the straight side wall 26 provided by the female end 25 of side piece 5 that engages (or is located close to) void area 24 to establish its position of use, female end 25 also has a second side wall 27 with an enlarged triangular end 28 (larger than triangle-shaped tip 22). As can be seen in FIGS. 1 and 5, the distal end of the second side wall 27 is slightly inwardly angled toward the longitudinal axis of female end 25. To create fitted snap connections 9 shown in FIG. 1, the angled distal surface (not separately numbered) on triangular-shaped tip 22 is forced to slide across the angled distal surface (not separately numbered) of enlarged triangular end 28 until the entirety of triangular-shaped tip 22 becomes housed within the receptacle formed on female end 25 and defined by straight side wall 26 and the second side wall 27. Once the fitted snap connections 9 are established, the substantially parallel positioning of the planar proximal end of triangular-shaped tip 22 with the planar proximal end of enlarged triangular end 28, the inwardly angled orientation of the distal portion of male end 21 beyond void area 24, the slightly inwardly-directed angling of enlarged triangular end 28, and the fact that triangular-shaped tip 22 has a width dimension slightly larger than the opening between wall 26 and enlarged end 28, all contribute to a tight-fitting and strong snap fitted connection 9. As a result, no fasteners (11 or other) are required to secure the side pieces 5 and 6 together in any of the fitted snap connections 9.

Whether using the present invention's self-mating beam 12, its fitted snap construction beam 1, or other preferred embodiments of the present invention beam (not shown), gusset-retaining slots 10 allow assembly of box beam (1, 12, or other) without the imprecise installer estimates for gussett plate 8 positioning that are an inherent part of the prior art. The resulting present invention beam joints are therefore, stronger, easier to construct, and more accurate/precise in their construction. Thus, present invention beams (1, 12, or other) are preferred in the construction of front walls and roof designs in gable, mansard, dome and flat screen enclosures. Furthermore, both self-mating and fitted snap configurations of the present invention do not interfere with putting screws into roof purlins (not shown). Also, when appropriate in the application, gusset-retaining slots 10 allow present invention beams (1, 12, or other) to be joined together precisely with thinner gusset plates 8 than is possible in prior art beams 20, saving material cost without compromising screen enclosure strength over that potentially constructed with prior art beams 20. Thus, the present invention provides an improved and more efficient system and method of constructing screen enclosures. While several fasteners are typically used to secure a gusset plate 8 to a present invention beam (1, 12, or other), the structural benefit provided by its gusset-retaining slots 10 allow the use of fewer fasteners (11 or other) than would otherwise be required for prior art beams (such as the beam 20 shown in FIG. 3). In some applications, only two fasteners 11 are needed to secure each gusset plate 8 to a beam, while as many as eighteen fasteners 11 may be needed for a gusset plate 8 connection to prior art beam 20. Advantages of the present invention system and method include, without limitation, stronger construction of aluminum beams (1, 12, and other), tailored construction of aluminum beams (1, 12, and other) to an exact fitted specification which greatly reduces the likelihood of construction error, and improved and stronger screen enclosures joints. The improved joint component of the present invention aluminum box beam (1, 12, and other) is also considerably stronger than that used in the prior art. Furthermore, the graduation in strength from one beam (1, 12, and other) to another is consistent, resulting in the metal being used efficiently and enhanced screen enclosure strength. Thus, screen enclosures made from present invention box beams (1, 12, and other) can withstand higher winds and external forces than other box beams currently used in the industry. Furthermore, it is contemplated for present invention beams (1, 12, and other) and their various components to be made of aluminum, as well as any other sufficiently rigid and strong material, such as but not limited to high strength plastic, other metals, and the like.

Figure 3:
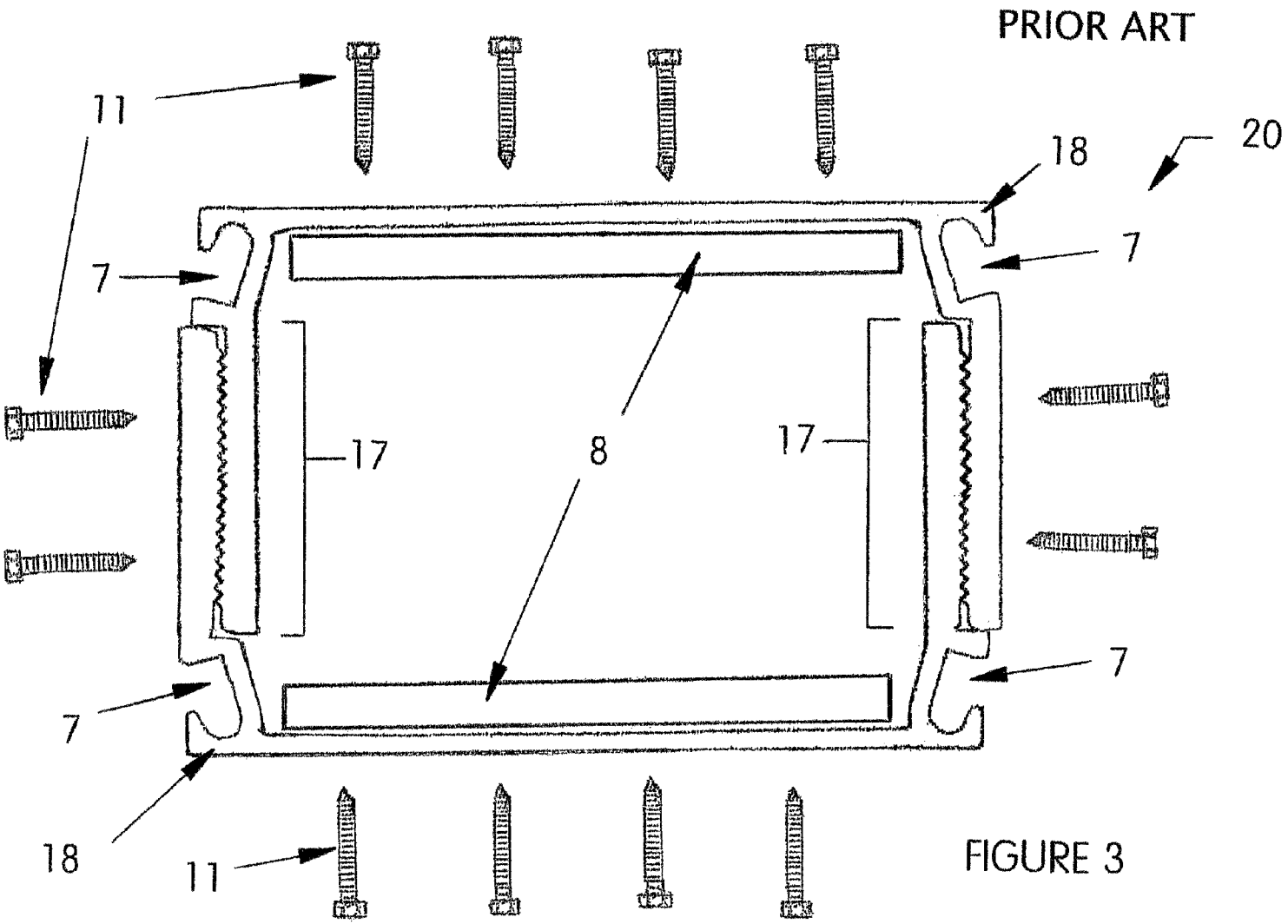
FIG. 3 is an end view of two typical prior art self-mating aluminum extrusions (without opposed interior slots) that are joined together to form an aluminum box beam, two non-tight-fitting gusset plates each positioned adjacent to a different one of the planar central members of the box beam, two fasteners poised to secure the side pieces of opposing extrusions to one another in each of two self-mating connections, and multiple fasteners poised for connection of each gusset plate to an adjacent portion of the box beam.

In comparison to the present invention, a prior art aluminum structural member 20 currently and commonly used in screen enclosure construction is shown in FIG. 3. Prior art beam 20 consists of two identical extrusions 18 that together to form a rectangular box configuration via self-mating construction. Although not limited thereto, a typical width dimension of box beam 20 (after assembly) is approximately two inches, while its length dimension is typically in the range of approximately four to nine inches. Each extrusion 18, which represents half of box beam 20, has a generally U-shaped configuration, two exterior-facing spline grooves 7 in substantially opposed positions from one another, and a self-mating area 17 adjacent to each spline groove 7 having a non-slip/serrated internal configuration. FIG. 3 also shows fasteners 11 poised adjacent to each self-mating area 17 for securing both extrusions 18 together to form the substantially rectangular box beam 20. Although not limited thereto, fasteners 11 used with prior art box beams 20 are typically screws.

Advantages of the present invention include, without limitation, improved beams (1 and 12) for use in constructing strong screen enclosures (not shown) that include slots 10 within them to assist in creating improved screen enclosure joints (stronger and more precise).

The present invention allows for tailored construction of the aluminum beams (1 and 12) to an exact fitted specification, reducing the opportunity for errors to be made during screen enclosure construction. The present invention beams (1 and 12) are stronger than prior art box beams (such as prior art beam 20 shown in FIG. 3), and the joint component in the present invention aluminum box beam (1, 12, or other) from a strength and structural perspective is considerably stronger than that found in the prior art, whether gusset plates 8 of similar thickness dimension (or smaller) are used in the present invention. The graduation in strength from one beam (1 or 12) to another is consistent, resulting in the metal being used efficiently and the screen enclosures stronger. As a result, screen enclosures made with present invention beams (1 or 12) can withstand higher winds and better resist impact from external forces. Another advantage of the present invention is that the opposed slots 10 in present invention box beams (1, 12, and others) allow for the joining of two roof beams in a manner that does not interfere with the placement of fasteners (11 or other) in roof purlins.

Adaptations and alterations in differing preferred embodiments of the present invention are limited only by the ingenuity of the engineer and the particular needs of a given application. As a result, it is to be understood that all terms used herein are descriptive rather than limiting. Although the invention has been specifically described with regard to the specific embodiments set forth herein, many alternative embodiments, modifications, and variations will be apparent to those skilled in the art in light of the disclosure set forth herein. Accordingly, it is intended for the enclosure herein to include all such alternatives, embodiments, modifications, and variations that fall within the spirit and scope of the invention as set forth in the claims herein below.

We claim:

1. A system of constructing screen enclosures for outdoor facilities, said system comprising:

a plurality of beams each having two identical extruded parts and opposing ends, each said extruded part having a generally U-shaped configuration with a planar central member and two side pieces each depending in substantially perpendicular orientation from said planar central member to form two opposed interior L-shaped corners, each said extruded part also having an interior-facing gusset-retaining slot formed in the L-shape of the corner, said gusset-retaining slots on each said extruded part further being paired slots that are positioned in opposed relation to one another, said gusset-retaining slots in each said paired slot also each having a width dimension substantially similar to the other, each said extruded part also having two exterior spline grooves each on a different one of said side pieces and which are also distanced from the adjacent most one of said interior L-shaped corners by an amount substantially equivalent to said width dimension of said gusset-retaining slots;

a plurality of elongated gusset plates each having opposing lateral edges and opposed ends, each said gusset plate also having a width dimension allowing said opposing lateral edges to become inserted within each of said gusset-retaining slots in one of said paired slots, each said gusset plate further having a thickness dimension allowing said gusset plate to become tight-fitting within said paired slots while also allowing said gusset plate to slide easily and promptly into a position of use between said paired slots; and a plurality of fasteners each having a length dimension extending through one of said planar central members and also through one of said gusset plates, said fasteners providing a secure connection between said extrusions and said gusset plates that become fastened to one another, wherein when two said gusset plates are partially inserted into a first selected one of said beams with said opposing lateral edges both inserted into a different pair of said opposed slots in tight-fitting relation, and said two gusset plates are secured with fasteners to said first selected one of said beams, and furthermore when a second selected one of said beams is placed in end-to-end relation with said first selected one of said beams so that the remaining portion of said two gusset plates attached thereto become completely inserted into said second selected one of said beams with said opposing lateral edges of said gusset plates both inserted into a different pair of said opposed slots in said second selected one of said beams in tight-fitting relation, and then when said two gusset plates are also secured with fasteners to said second selected one of said beams, precise and strong structural joints are formed that allow accurate and efficient construction of strong screen enclosures, reduced construction error, and consistent graduation in strength from one said beam to another that is better able to withstand high winds and better resist impact from external forces.

2. The system of claim 1 further comprising self-mating connection of said extrusions to one another, with each said self-mating connection being secured by at least one fastener.

3. The system of claim 2 wherein each said extrusion in one said self-mating connection has a serrated configuration, and both said serrated configurations in said self-mating connection are positioned to engage one another.

4. The system of claim 3 wherein a portion of said side pieces in both of said extrusions secured by one said self-mating connection are configured to provide a length defining stop.

5. The system of claim 2 wherein a portion of said side pieces in both of said extrusions secured by one said self-mating connection are configured to provide a length defining stop.

6. The system of claim 1 further comprising self-mating connection of said extrusions to one another, with each said self-mating connection having fitted snap connection.

7. The system of claim 6 wherein said fitted snap connection further comprises male and female members each having a triangular-shaped distal end.

8. The system of claim 7 wherein said fitted snap connection further comprises male and female members each having an inwardly angled component that assists in strengthening said fitted snap connection.

9. The system of claim 8 wherein male member of said fitted snap connection further comprises a void area that is configured to provide a stop for a portion of said female member that assists in defining the minimum length dimension possible for said fitted snap connection.

10. The system of claim 1 to which purlins are secured with fasteners as part of the construction of screen enclosures for outdoor facilities, wherein said positioning of said gusset-retaining slots in said corners of said beams that distances said exterior spline grooves away from said planar central member allows the joining of two roof beams in a manner that does not interfere with the placement of fasteners during attachment of roof purlins to said beams.

11. A box beam used with gusset plates for constructing screen enclosures for outdoor facilities, said box beam comprising:

two identical extruded parts, each said extruded part having a generally U-shaped configuration with a planar central member and two side pieces each depending in substantially perpendicular orientation from said planar central member to form two opposed interior L-shaped corners, each said extruded part also having an interior-facing gusset-retaining slot formed in the L-shape of the corner, said gusset-retaining slots on each said extruded part further being paired slots that are positioned in opposed relation to one another, said gusset-retaining slots in each said paired slot also each having a width dimension substantially similar to the other, each said extruded part further having two exterior spline grooves each on a different one of said side pieces and which are also distanced from the adjacent most one of said interior L-shaped corners by an amount substantially equivalent to said width dimension of said gusset-retaining slots, wherein said paired slots provide tight-fitting gusset plate connections when two of said box beams are connected in end-to-end relation with gusset plates to create a structural joint.

12. The beam of claim 11 further comprising self-mating connection of said extrusions to one another, with each said self-mating connection being secured by at least one fastener.

13. The beam of claim 11 further comprising self-mating connection of said extrusions to one another, with each said self-mating connection having fitted snap connection.

* * * * *